US006238748B1

(12) United States Patent
Nakamura et al.

(10) Patent No.: US 6,238,748 B1
(45) Date of Patent: May 29, 2001

(54) MULTILAYER COATING FILM FORMATION PROCESS

(75) Inventors: Shigeru Nakamura; Naruhito Ueno, both of Aichi-ken (JP)

(73) Assignee: Kansai Paint Co., Ltd., Hyogo (JP)

( * ) Notice: Subject to any disclaimer, the term of this patent is extended or adjusted under 35 U.S.C. 154(b) by 0 days.

(21) Appl. No.: 09/297,765

(22) PCT Filed: Nov. 8, 1996

(86) PCT No.: PCT/JP96/03278

§ 371 Date: May 7, 1999

§ 102(e) Date: May 7, 1999

(87) PCT Pub. No.: WO98/20984

PCT Pub. Date: May 22, 1998

(30) Foreign Application Priority Data

May 17, 1995 (JP) ..... 7-118743

(51) Int. Cl.[7] ..... B05D 1/38; B05D 3/02; B05D 7/16

(52) U.S. Cl. ..... 427/458; 427/380; 427/407.1; 427/409

(58) Field of Search ..... 427/409, 407.1, 427/458, 380

(56) References Cited

U.S. PATENT DOCUMENTS

| | | | | |
|---|---|---|---|---|
| 4,455,331 | * | 6/1984 | Barsotti | 427/407.2 |
| 4,615,940 | * | 10/1986 | Panush et al. | 427/407.2 |
| 4,668,570 | * | 5/1987 | Esselborn et al. | 427/409 |
| 4,732,791 | * | 3/1988 | Blackburn et al. | 427/407.1 |
| 4,814,208 | * | 3/1989 | Miyazaki et al. | 427/402 |
| 5,213,618 | * | 5/1993 | Souma et al. | 427/217 |
| 5,633,037 | * | 5/1997 | Mayer | 427/9 |
| 5,676,713 | * | 10/1997 | Nakamura et al. | 427/409 |
| 5,693,134 | * | 12/1997 | Stephens | 427/419.2 |
| 5,718,950 | * | 2/1998 | Komatsu et al. | 427/405 |
| 5,725,908 | * | 3/1998 | Ogasawara et al. | 427/409 |
| 5,855,660 | * | 1/1999 | Bujard et al. | 106/418 |
| 5,871,827 | * | 2/1999 | Jaffe et al. | 427/407.1 |
| 5,945,218 | * | 8/1999 | Nakao et al. | 427/409 |

FOREIGN PATENT DOCUMENTS

| | | |
|---|---|---|
| 1-119376 | 5/1989 | (JP) . |
| 2-132171 | 5/1990 | (JP) . |
| 6-299100 | 10/1994 | (JP) . |
| 8-196982 | 8/1996 | (JP) . |

* cited by examiner

*Primary Examiner*—Erma Cameron
(74) *Attorney, Agent, or Firm*—Wenderoth, Lind & Ponack, L.L.P.

(57) ABSTRACT

The present invention provides a process of a forming multilayer coating film characterized by that in a process of forming a multilayer coating film by successively coating with an undercoat paint (A), an intermediate paint (B) and a topcoat paint (C) on a substrate, (1) to use a liquid thermocurable paint containing 0.1–30 parts by weight of aluminium powder and 1–200 parts by weight of titanium oxide pigment per 100 parts by weight of a thermosetting resin composition and the hiding film thickness of its coating film being less than 25 $\mu$m as said intermediate paint (B), (2) to use a solid color paint, a metallic paint or an interference pattern paint as said topcoat paint (C), and (3) to coat said topcoat paint (C) after curing by heating of the coating film of said intermediate paint (B). By this process it is possible to make an intermediate coating film thinner and to form a multilayer coating film with excellent smoothness.

13 Claims, No Drawings

MULTILAYER COATING FILM FORMATION PROCESS

This application is a 371 application of PCT/JP96/03278 filed Nov. 8, 1996.

TECHNICAL FIELD

The present invention relates to a process of forming a multilayer coating film with excellent smoothness and with thinner intermediate coating film without deteriorating the coating film properties by using an intermediate paint with a specific pigment composition and by coating a topcoat paint after curing of the coating film of said intermediate paint, when a multilayer coating film is formed by successive coatings by an undercoat paint, an intermediate paint and a topcoat paint.

BACKGROUND TECHNOLOGY

A process of forming a multilayer coating film by successively coating with an undercoat paint (such as an electrodeposition paint), an intermediate paint and a topcoat paint is known. Concerning the intermediate paint, however, it is necessary to coat to a thick coating film of usually more than 30 μm (as a cured coating film) in order to hide the undercoat layer and to maintain the coating film properties. Therefore, it is desired to lower the coating cost of the whole multilayer coating film by making the intermediate coating film thinner without deteriorating the hiding properties and the coating film properties.

The present inventors had been conducting an intensive research to solve these problems and as a result they found that in a process of successive coatings by an undercoat paint, an intermediate paint and a topcoat paint it is possible to make the intermediate coating film thinner with improved undercoat hiding properties and chipping resistance of the intermediate coating film and, in addition, with improved smoothness of the topcoat surface by using a thermocurable paint containing both components of aluminium powder and titanium oxide pigment as the intermediate paint and by coating a topcoat paint after curing of the intermediate coating film, and completed the present invention.

DISCLOSURE OF THE INVENTION

Thus the present invention provides a process of forming a multilayer coating film characterized by that in a process of forming a multilayer coating film by successively coating a substrate with an undercoat paint (A), an intermediate paint (B) and a topcoat paint (1) to use a liquid thermocurable paint containing (C), 0.1–30 parts by weight of aluminium powder and 1–200 parts by weight of titanium oxide pigment per 100 parts by weight of a thermosetting resin composition and the hiding film thickness of its coating film being less than 25 μm as said intermediate paint (B), (2) to use a solid color paint, a metallic paint or an interference pattern paint as said topcoat paint (C), and (3) to coat said topcoat paint (C) after curing by heating of the coating film of said intermediate paint (B).

The process of forming a multilayer coating film of the present invention (hereinafter referred to as "the process") is described more specifically hereinbelow.

Undercoat paint (A):

Undercoat paint (A) is used to give anticorrosivity, adhesivity etc. by directly coating a substrate made of metal or plastics. In the process any usual undercoat paint can be used without special restriction, only if it suits to these purposes. As a substrate applicable to said undercoat paint outer panels of automobile are particularly preferable. It is usually desirable to suitably conduct rust removal, washing and chemical treatments of the substrate previously.

If a substrate is metalbacked or has an electroconductive surface, a cationic electrodeposition paint is preferable as an undercoat paint. As a cationic electrodeposition paint there can be used a per se known one comprising an aqueous solution or aqueous dispersion of a salt of cationic high polymer compound, compounded, as necessary, with crosslinking agent, pigment and various additives and its sort is not specially restricted. As a cationic high polymer compound there can be mentioned, for example, acrylic resin or epoxy resin having crosslinking functional groups in which cationic groups such as amino groups are introduced. They can be made water-soluble or water-dispersible through neutralization with an organic acid or an inorganic acid. As a crosslinking agent to cure these high polymer compounds block polyisocyanate compounds, alicyclic epoxy resins etc. can be preferably used.

Electrodeposition coating can be conducted by dipping metallic substrates such as outer panels of automobile or bumpers as a negative electrode in a bath of said cationic electrodeposition paint and by depositing the paint on said substrate by sending an electric current between it and a positive electrode under the usual conditions. The thickness of the formed electrodeposition coating film is preferable usually in a range of 10–40 μm based upon a cured coating film, and a coating film can be cured by crosslinking through heating at about 140 to about 220° C. for about 10 to about 40 minutes. In the process it is preferable to coat an intermediate paint after curing said electrodeposition coating film. Optionally, however, an intermediate paint can be coated during the latter is in the uncured state.

Intermediate Paint (B):

In the process a liquid thermocurable paint containing 0.1–30 parts by weight of aluminium powder and 1–200 parts by weight of titanium oxide pigment per 100 parts by weight of a thermosetting resin composition and the hiding film thickness of its coating film being less than 25 μm as the intermediate paint (B), Using both aluminium powder and titanium oxide pigment in the intermediate paint (B) increases the hiding power of the coating film and make it possible to sufficiently hide the undercoat surface with a cured coating film of less than 25 μm, especially with a thin film of 10–25 μm and thus can achieve making the intermediate coating film thinner.

Thermosetting resin composition which is used as a vehicle component in such an intermediate paint (B) consists fundamentally of a base resin and a cross-linking agent or a self-crosslinking type resin. As a base resin there can be mentioned, for example, acrylic resin, polyester resin, alkyl resin etc. having more than 2 crosslinking functional groups such as hydroxyl group, epoxy group, isocyanate group, carboxyl group etc. in the molecule. As a crosslinking agent there can be used, for example, amino resins such as melamine resin, urea resin etc., polyisocyanate compounds which may be blocked, compounds containing carboxyl groups etc. As the above-mentioned self-crosslinking type resin there can be mentioned, for example, resins containing more than 2 alkoxysilane groups in the molecule, resins containing a carboxyl group(s) and a hydroxyl group (s) in the molecule, resins containing a hydroxyl group (s) and an isocyanate group(s) which may be blocked etc. These resins are based upon, for example, vinyl resin, acrylic resin, polyester resin, urethane resin etc.

As aluminium powder to be compounded in the intermediate paint (B) aluminium powder whose average particle diameter is generally less than 40 μm, preferably less than 10 μm, and more preferably in a range of 3–7 μm is suitable. Particularly, if fine powder of an average particle diameter of less than 10 μm is used, the formed intermediate coating film itself has no brilliance. "Average diameter" here means a median diameter measured by laser diffraction scattering (LA-500). The main component of this aluminium powder is metallic aluminium, whose surface may be treated with a silane coupling agent or the like.

As titanium oxide pigment to be compounded in the intermediate paint (B) according to the process those which are per se known as pigments for paint can be used. Their average particle diameter is preferable to be generally 5 μm. Moreover, the surface of said titanium oxide pigment may be treated with alumina, silica etc.

Concerning compounding amount of aluminium powder and titanium oxide pigment per 100 parts by weight of a thermosetting resin composition (as solid content) aluminium powder can be in a range of 0.1–30 parts by weight, preferably 0.5–20 parts by weight and more preferably 1–7 parts by weight and titanium oxide pigment can be in a range of 1–200 parts by weight, preferably 40–160 parts by weight and more preferably 80–120 parts by weight. Furthermore, aluminium powder is preferably used in a range of 1–15 parts by weight, preferably 1.5–10 parts by weight and more preferably 2–7 parts by weight per 100 parts by weight of titanium oxide pigment.

It is indispensable that the intermediate paint (B) which is used in the process contains both aluminium powder and titanium oxide pigment. Total compounding amount of both pigments can be selected to be an amount which enables to make the hiding film thickness of the coating film to be formed by using said paint (B) less than 25 μm, particularly less than 10–25 μm (as cured coating film). "Hiding film thickness" here means the minimum film thickness of a coating film through which the color of the surface to be coated cannot be recognized and specifically means the minimum film thickness of a coating film coated on a plate with black and white checkered pattern through which black and white cannot be discriminated by the naked eye. In the process compounding both aluminium powder and titanium oxide pigment in combination at specified amounts enables to make the hiding film thickness of a coating film a thin film of less than 25 μm. In other words, a thin film of even less than 25 μm can sufficiently hide the color of the ground. Without any of these both components it is difficult to hide with such a thin film.

Intermediate paint (B) can be prepared by mixing and dispersing the above-mentioned thermosetting resin composition, aluminium powder and titanium oxide pigment in a solvent such as an organic solvent and/or water. Furthermore other color pigments than the above-mentioned aluminium powder and titanium oxide pigment, extender pigment, antisettle agent etc. can be suitably compounded, as necessary.

Said intermediate paint (B) is preferably coated in a film thickness of less than 25 μm, particularly in a range of 10–25 μm based upon a cured coating film on the cured or uncured undercoat surface by means of electrostatic coating, air spray, airless spray etc.

In the process a topcoat paint (C) mentioned below is coated after the coating film of the intermediate paint (B) has been cured by heating. Curing by heating of the coating film of the intermediate paint (B) can be conducted, for example, by heating said coating film at temperatures of about 140 to about 200° C. for about 10 to about 40 minutes.

Topcoat paint (C):

According to the present invention solid color paint (C-1), metallic paint (C-2) or interference pattern paint (C-3) is coated as a topcoat paint on the cured coating surface of the intermediate paint(B). All of these topcoat paints are desirably of thermocurable type.

First of all, as a solid color paint (C-1) there is used preferably a liquid thermocurable paint containing a thermosetting resin composition and a color pigment as main components and substantially not containing metallic pigment or interference color pigment.

Thermosetting resin composition which is used in a color paint (C-1) consists fundamentally of a base resin and a crosslinking agent or a self-crosslinking type resin. As a base resin there can be mentioned, for example, acrylic resin, polyester resin, alkyl resin etc. having more than 2 crosslinking functional groups such as hydroxyl group, epoxy group, isocyanate group, carboxyl group etc. in the molecule. As a crosslinking agent there can be mentioned, for example, amino resins such as melamine resin, urea resin etc., polyisocyanate compounds which may be blocked, compounds containing carboxyl groups etc. Further, as the above-mentioned self-crosslinking type resin there can be mentioned, for example, resins containing more than 2 alkoxysilane groups in the molecule, resins containing a carboxyl group(s) and a hydroxyl group (s) in the molecule, resins containing a hydroxyl group (s) and an isocyanate group(s) which may be blocked etc. These resins are based upon, for example, vinyl resin, acrylic resin, polyester resin, urethane resin etc.

Color pigment which can be compounded in a solid color (C-1) does not substantially contain metallic pigment or interference pigment but is a component to give solid color to the multi layer coating film which is formed according to the process of the present invention and usual organic or inorganic color pigments for paint can be used. Specifically there can be mentioned, for example, inorganic pigments such as titanium oxide, zinc oxide, carbon black, cadmium red, molybdenum red, chrome yellow, chrome oxide, Prussian Blue, Cobalt Blue; organic pigments such as azo pigment, phthalocyanine pigment, quinacridone pigment, isoindoline pigment, threne type pigment, perylene pigment etc. These pigments desirably have an average particle diameter of generally less than 5 μm.

Compounding amount of these color pigments can be freely selected according to the coloring power of the pigment itself and the purpose. It can be in a range of generally 0.5–200 parts by weight, preferably 1–150 parts by weight per 100 parts by weight of the thermosetting resin composition and an amount which allows the hiding film thickness of the coating film to be formed to be less than 50 μm, particularly less than 40 μm as a cured coating film.

Solid color paint (C-1) can be prepared by mixing and dispersing the above-mentioned components in a solvent such as an organic solvent and/or water. In said paint, as necessary, extender pigment, antisettle agent etc. can be further compounded suitably.

As a metallic paint (C-2) there can be used preferably a liquid thermocurable paint containing a thermosetting resin composition, about which is mentioned above in the item of a solid color paint (C-1), and a metallic pigment as main components. Metallic pigment which is compounded in this metallic paint is a scale-like particle pigment of metal or metal oxide having a glittering brilliancy and specifically there can be mentioned, for example, aluminium flake, mica-like iron oxide etc. These scale-like pigment particles can have an average particle diameter of generally more than 10 μm, preferably in a range of 10–50 μm and more preferably in a range of 15–40 μm. Compounding amount of these metallic pigments can be in a range of generally 0.1–20 parts by weight, preferably 3–10 parts by weight per 100 parts by weight of the thermosetting resin composition and an amount which allows the hiding film thickness of the coating film to be formed to be less than 50 μm, particularly less than 30 μm as a cured coating film.

Metallic paint (0–2) can be prepared by mixing and dispersing the above-mentioned components in a solvent such as an organic solvent and/or water. In said paint, as necessary, extender pigment, color pigment, antisettle agent etc. can be compounded suitably. As a metallic paint (C-2) contains metallic pigment with relatively large particle diameter, the coating film of said metallic paint itself shows a glittering brilliancy.

As an interference pattern paint (C-3) there is used preferably a liquid thermocurable paint containing a thermosetting resin composition, about which is mentioned above in the item of a solid color paint (C-1), and an interference pigment as main components. As an interference pigment which is compounded in this interference pattern paint, scale-like mica, whose surface is covered with metal oxide such as titanium oxide, iron oxide etc., so-called interference mica, is particularly preferable. Covering thickness of metal oxide on this interference mica is desirably more than 200 nm based upon an optical thickness and more than 80 nm based upon a geometrical thickness. If said covering thickness is less than mentioned above, it is not preferable because the interference action by light generally lowers. Said interference pigment can have an average particle diameter of generally more than 10 μm, preferably in a range of 10–50 μm and more preferably in a range of 15–40 μm.

Compounding amount of said interference pigment can be in a range of generally 1–100 parts by weight, preferably 5–50 parts by weight per 100 parts by weight of the thermosetting resin composition.

Interference pattern paint (C-3) can be prepared by mixing and dispersing the above-mentioned components in a solvent such as an organic solvent and/or water. In said paint, as necessary, color pigment, metallic pigment, extender pigment, antisettle agent etc. can be compounded suitably.

The above-mentioned topcoat paints (C) are preferably coated in a film thickness in a range of 10–60 μm, particularly in a range of 20–35 μm based upon a cured coating film on the cured intermediate coating surface by means of electrostatic coating, air spray, airless spray etc.

The coating film of the above-mentioned top-coat paints (C) can be cured, for example, by heating at temperatures of about 120 to about 180° C. for 10–40 minutes.

Clear paint (D):

In the process, A clear paint (D) may be coated, as necessary, on the coating surface of the topcoat paint (C) of the multilayer coating film formed as mentioned above. The clear paint (D) can be coated on the coating surface of the topcoat paint (C) formed as mentioned above in the cured or uncured state.

As a clear paint (D), there can be preferably used a liquid paint comprising a thermosetting resin composition and a solvent as main components, and, as necessary, color pigment, metallic pigment, interference pigment, ultraviolet absorber and other additives for paint to such an extent as not to deteriorate the transparent feeling of the coating film.

The above-mentioned thermosetting resin composition consists fundamentally of a base resin and a crosslinking agent, or a self-crosslinking type resin. As a base resin there can be mentioned, for example, acrylic resin, polyester resin, alkyl resin, urethane resin etc. having more than 2 crosslinking functional groups such as hydroxyl group, epoxy group, isocyanate group, carboxyl group etc. in the molecule. As a cross-linking agent there can be mentioned, for example, melamine resin, urea resin, polyisocyanate compounds which may be blocked, compounds containing carboxyl groups etc. Further, as a self-crosslinking type resin there can be mentioned, for example, resins containing more than 2 alkoxysilane groups in the molecule, resins containing a carboxyl group(s) and a hydroxyl group (s) in the molecule, resins containing a hydroxyl group (s) and an isocyanate group(s) which may be blocked, etc. These resins are based upon, for example, vinyl resin, acrylic resin, polyester resin, urethane resin etc.

As a solvent, an organic solvent and/or water can be used. By dissolving or dispersing the above-mentioned thermosetting resin composition and other components in such a solvent, a clear paint (D) can be prepared.

The clear paint (D) can be coated on the uncured or cured coating surface of the topcoat paint (C) formed as mentioned above by means of electrostatic coating, air spray, airless spray etc. Its film thickness is preferably in a range of 10–60 μm and particularly 20–50 μm based upon a cured coating film. The coating film itself of said clear paint (D) can be cured by crosslinking at temperatures of about 120 to about 180° C. for 10–40 minutes.

According to the above-mentioned process of forming a multilayer coating film of the present invention, for example, there are obtained the effects mentioned below:

(1) The cost of the whole multilayer coating film can be lowereed, because the film thickness of the intermediate coating film can be made thinner (less than 25 μm, preferably 10–20 μm) than before (usually more than 30 μm).

(2) The smoothness of the topcoat coating film is excellent, because the topcoat paint is coated after the intermediate coating film has been cured by heating.

(3) As the intermediate paint has an excellent hiding properties of the ground, the color stability of the topcoat coating film is good even when coated with a thin coating film and the color design of the topcoat coating film can be freely changed according to the purposes.

(4) Formed multilayer coating film has an excellent chipping resistance.

EXAMPLE

The process of the present invention is described more specifically by means of examples and comparative examples as follows:

I. Sample (1) Cationic electrodeposition paint (A)

"ELECTRON9400HB" (made by Kansai Paint; trade name; epoxy resin polyamine block isocyanate compound type)

(2) Intermediate paint (B)

Organic solvent type paints comprising polyester resin, melamine resin, fine aluminium powder and titanium oxide pigment in the ratios shown in the following Table 1. Compounding amount of each component in Table 1 is the solid content ratio by weight.

TABLE 1

| | | intermediate paint (B) | | | | |
|---|---|---|---|---|---|---|
| | | B-1 | B-2 | B-3 | B-4 | B-5 |
| Polyester resin | (*1) | 65 | 70 | 75 | 70 | 70 |
| Melamine resin | (*2) | 35 | 30 | 25 | 30 | 30 |
| Fine aluminum powder | (*3) | 5 | 2 | 2 | — | 2 |
| Titanium oxide pigment | (*4) | 120 | 100 | 80 | 80 | — |
| Iron oxide pigment (red) | (*5) | 2 | 2 | 2 | 2 | 2 |
| Hiding film thickness (μm) | (*6) | 11 | 13 | 15 | 100 | 150 |

(*1): Polyester resin of phthalic anhydride-hexahydro-phthalic anhydride type (number average molecular weight: about 4000, hydroxyl group value: 82, acid value: 7)
(*2): U-Van28-60 (made by Mitsui-Toatsu Chemicals; trade name)
(*3): K-9800 (made by Asahi Chemical; trade name), average paraticle diameter: 5–6 μm
(*4): TITANJR701 (made by Teikoku Kako; trade name), average paraticle diameter: 0.3–0.6 μm
(*5): KNO-W iron oxide (made by Toda Kogyo; trade name), average paraticle diameter: 0.2–0.5 μm (red solid color pigment)
(*6): The minimum film thickness (μm) of a coating film coated on a black and white plate with checkered pattern through which black and white cannot be discriminated by the naked eye was measured.

TABLE 2-continued

| | | Topcoat paint (C) | | |
|---|---|---|---|---|
| | | C-1 | C-2 | C-3 |
| Interference pigment | (*11) | — | 9 | 9 |
| Hiding film thickness (μm) | (*6) | 100< | 100< | 100< |

(*7): Acrylic resin of methyl methacrylate type with number average molecular weight of about 2000, hydroxyl group value of 70 and acid value of 8
(*8): U-Van28-60 (made by Mitsui-Toatsu Chemicals; trade name)
(*9): TITANCR93 (made by Ishihara Sangyo; trade name)
(*10): CarbonFW200 (made by DEGUSSA; trade name)
(*11): Exterior Highlight Blue (made by Mahl; trade name; average paraticle diameter: 14–18 μm)

(5) Clear Paint (D)

"Magicron Clear" (made by Kansai Paint; trade name; acrylic resin-melamine resin type; organic solvent type)

II. Examples and comparative examples

Multilayer coating films were formed by coating, using the above-mentioned samples and according to the coating procedures shown in Table 3, followed by curing by heating. In Table 3 the results of the performance tests of the multilayer coating films are mentioned, too.

TABLE 3

| | Examples | | | Comparative examples | | |
|---|---|---|---|---|---|---|
| | 1 | 2 | 3 | 1 | 2 | 3 |
| Electrodeposition paint | (A) | | | | | |
| Heating condition | 170° C., 30 min. | | | | | |
| Intermediate paint | B-1 | B-2 | B-3 | B-4 | B-5 | B-1 |
| Drying condition | 140° C., 30 min. | | | | | room temp., 5 min. |
| Topcoat paint | C-1 | C-2 | C-3 | C-1 | C-2 | C-1 |
| Drying condition | 140° C., 30 min. | room temp., 5 min. | | 140° C., 30 min. | room temp., 5 min. | 140° C., 30 min. |
| Clear paint | — | D | | — | D | — |
| Heating condition | — | 140° C., 30 min. | | — | 140° C., 30 min. | — |
| Results of performance test | | | | | | |
| Smoothness | ○ | ○ | ○ | ○ | ○ | X |
| Finishing appearance | ○ | ○ | ○ | X | X | Δ |
| Metallic feeling | — | ○ | ○ | — | Δ | — |
| Chipping resistance | ○ | ○ | ○ | Δ | Δ | ○ |

(3) Topcoat paint (C)

Organic solvent type paints comprising acrylic resin, melamine resin, solid color pigment or metallic pigment in the ratios shown in the following Table 2.

Compounding amount of each component in Table 2 is the solid content ratio by weight.

TABLE 2

| | | Topcoat paint (C) | | |
|---|---|---|---|---|
| | | C-1 | C-2 | C-3 |
| Acrylic resin | (*7) | 65 | 70 | 75 |
| Melamine resin | (*8) | 35 | 30 | 25 |
| Titanium white pigment | (*9) | 80 | — | — |
| Carbon black | (*10) | 0.2 | — | — |

The cationic electrodeposition paint (A) was painted by electrodeposition on a steel plate, which had been degreased and treated with zinc phosphate, to the film thickness of 20 μm according to the usual method and the coating film was cured by heating at 170° C. for 30 minutes. On said electrodeposition coating surface an intermediate paint (B-1)–(B-5) was coated so that the film thickness would be 25 μm and the intermediate coating film was cured by heating at 140° C. for 30 minutes in Examples 1–3 and in Comparative example 1 and 2, while it was kept standing at room temperature for 5 minutes in Comparative example 3. Then on the intermediate coating surface a topcoat paint (C-1)–(C-3) was coated using a minibell type rotary electrostatic coater under the conditions of output 150 cc, rotation number 50000 rpm, shaping pressure 1 kg/cm$^2$, gun distance 30 cm, booth temperature 20° C., booth humidity 75%. Coating film thickness was 15–25 μm. After said topcoat paint had been kept standing in the booth for 5 minutes, the coating film of the topcoat paint (C) was cured by heating at 140° C. for 30 minutes in Example 1 and in Comparative example 1 and 3. On the other hand, in Examples 2 and 3 and Comparative example 2, a clear paint (D) was coated on the uncured coating surface of the topcoat paint (C) using a minibell type rotary electrostatic coater under the conditions of output 300 cc, rotation number 40000 rpm, shaping pressure 5 kg/cm$^2$, gun distance 30 cm, booth temperature 20° C., booth humidity 75%. Coating film thickness was 45–50 μm. After being kept standing at room temperature for 3 minutes after coating, the double layer coating film consisting of the above-mentioned topcoat paint (C) and clear paint (D) was simultaneously cured by heating at 140° C. for 30 minutes using a hot air circulation type drying furnace.

Coating film performance test methods and evaluation standards are as follows:

Smoothness: Visual evaluation.

○: good, Δ: a little face roughening,

X: remarkable face roughening.

Finishing appearance: Color floating and hiding properties are visually evaluated.

○: good, Δ: fairly good, X: no good.

Metallic feeling: Visual evaluation about metallic mottling etc.

○: good, Δ: fairly good, X: no good.

Chipping resistance: Using Gravelometer (Made by Q Panel) as a testing machine, a shock is given to a coating film by blowing 500 g of No.7 crushed stones by an air pressure of 3 kg/cm$^2$ at 20° C. onto the coating surface at an angle of 45°. Then an adhesive tape is stuck on said coating surface, and the state of peeling-off of the coating film around the crack caused by the shock is examined, after rapidly peeling-off the adhesive tape.

○: No or little peeling-off of the coating film around the crack is observed.

Δ: Peeling-off of the coating film around the crack is clearly observed.

X: Peeling-off of the coating film around the crack is remarkably observed.

What is claimed is:

1. A multilayer coating film formation process characterized by that in a process of forming a multilayer coating film by successively coating with an undercoat paint (A), an intermediate paint (B) and a topcoat paint (C) on a substrate, (1) to use a liquid thermocurable paint containing 0.1–30 parts by weight of aluminium powder and 1–200 parts by weight of titanium oxide pigment per 100 parts by weight of a thermosetting resin composition and the hiding film thickness of its coating film being less than 25 μm as said intermediate paint (B), (2) to use a solid color paint, a metallic paint or an interference pattern paint as said topcoat paint (C), and (3) to coat said topcoat paint (C) after curing by heating of the coating film of said intermediate paint (B).

2. The process set forth in claim 1, wherein the aluminium powder contained in the intermediate paint (B) has an average particle diameter of less than 40 μm.

3. The process set forth in claim 2, wherein the aluminium powder has an average particle diameter of less than 10 μm.

4. The process set forth in claim 1, wherein the titanium oxide pigment contained in the intermediate paint (B) has an average particle diameter of less than 5 μm.

5. The process set forth in claim 1, wherein the intermediate paint (B) contains 1–7 parts by weight of aluminium powder and 80–120 parts by weight of titanium oxide pigment per 100 parts by weight of the thermosetting resin composition.

6. The process set forth in claim 1, wherein the intermediate paint (B) contains 1–15 parts by weight of aluminium powder per 100 parts by weight of titanium oxide pigment.

7. The process set forth in claim 1, wherein the hiding film thickness of the coating film of the intermediate paint (B) is less than 10–25 μm.

8. The process set forth in claim 1, wherein the intermediate paint (B) is coated so that the film thickness becomes in a range of 10–25 μm based upon the cured coating film.

9. The process set forth in claim 1, wherein the coating film of the intermediate paint (B) is cured by heating at temperatures of about 140 to about 200° C.

10. The process set forth in claim 1, wherein the topcoat paint (C) is coated so that the film thickness becomes in a range of 10–60 μm based upon the cured coating film.

11. The process set forth in claim 1, wherein the coating film of the topcoat paint (C) is cured by heating at temperatures of about 120 to about 180° C.

12. The process set forth in claim 1, wherein the undercoat paint (A) is a cationic electrodeposition paint.

13. The process set forth in claim 1, wherein a clear paint (D) is further coated on the coating surface of the topcoat paint (C).

* * * * *